United States Patent [19]

Fairweather et al.

[11] 4,040,668

[45] Aug. 9, 1977

[54] GROOVE CUTTING APPARATUS

[75] Inventors: Ernest Sidney Fairweather, London; Philip Jackson, Barlborough, near Chesterfield, both of England

[73] Assignee: Errut Products Limited, London, England

[21] Appl. No.: 643,937

[22] Filed: Dec. 23, 1975

[30] Foreign Application Priority Data

June 30, 1975 United Kingdom ..... 27523/75

[51] Int. Cl.[2] ..... E01C 23/09

[52] U.S. Cl. ..... 299/39; 172/45; 299/86; 299/89

[58] Field of Search ..... 299/39–41, 299/85, 86, 89; 172/45

[56] References Cited

U.S. PATENT DOCUMENTS

| | | | |
|---|---|---|---|
| 2,349,949 | 5/1944 | Farrell | 299/39 |
| 2,509,163 | 5/1950 | Musselman | 172/45 |
| 3,020,694 | 2/1962 | Foshee et al. | 172/45 X |
| 3,598,446 | 8/1971 | Hatcher | 299/39 |
| 3,695,722 | 10/1972 | Fairweather et al. | 299/39 |
| Re. 12,659 | 6/1907 | Williams | 172/45 |

*Primary Examiner*—Ernest R. Purser

[57] ABSTRACT

Groove cutting apparatus having a rotatable cutting drum comprising a plurality of spaced drum segments coaxially mounted on a central shaft. A plurality of secondary shafts are spaced circumferentially around the central shaft and supported by the drum segments. Apertured cutting members are mounted on the secondary shafts and spacéd by the drum segments.

8 Claims, 7 Drawing Figures

GROOVE CUTTING APPARATUS

Figure 1:
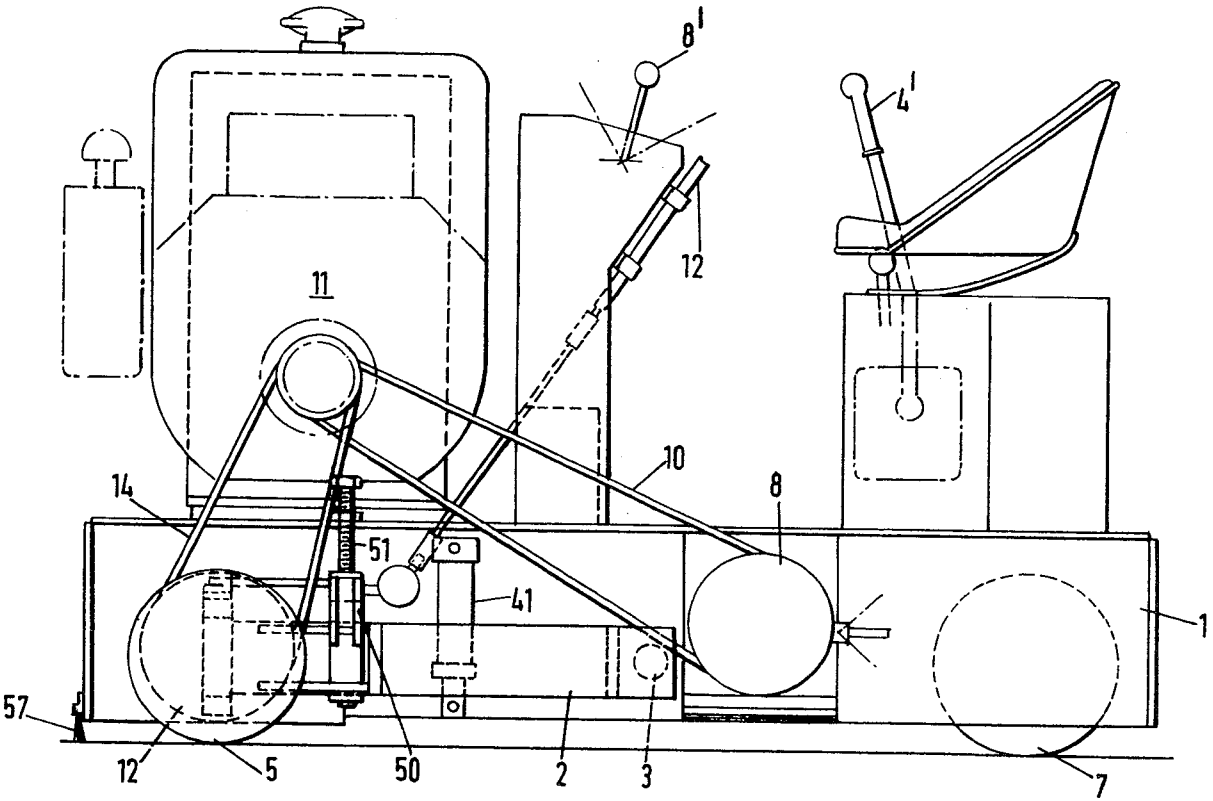

The present invention relates to groove-cutting apparatus, particularly, but not exclusively for cutting clearly-defined spaced transverse grooves in concrete roads, e.g. motor ways.

The advantages of such transverse grooves have become well known in recent years. Not only do they increase skid resistance in dry conditions, but also in wet conditions. Furthermore, surface water, e.g. from heavy rainfall, drains away along the grooves, thereby preventing aquaplaning of vehicle tyres, maintaining good tyre to surface contact, and reducing spray and mist thrown up by the tyres.

In our U.S. Pat. No. 3,695,722 we described such apparatus and tines for forming transverse surface grooves. The apparatus has a cutting assembly comprising two spaced end spiders mounted on a central driven shaft. The spiders support a plurality of secondary shafts each carrying a plurality of slotted tine-shaped cutting members spaced along the shafts by means of spacers. A disadvantage of such apparatus is that if a cutting member or spacer should break off, then it must be replaced immediately, otherwise the remaining cutting members on that shaft are free to slide sideways, and the grooves formed become less-clearly defined. Furthermore, the remaining cutting members on that shaft are more liable to wear badly or break.

The above-described apparatus can be used for cutting transverse grooves in a worn concrete road so as to prolong the use of the road. However, the depth of the grooves formed will vary as the apparatus rides over dips and bumps in the road.

Furthermore, large quantities of dust are thrown up by the above-described apparatus, which causes discomfort to the operator and anyone in the vicinity.

An object of the present invention is at least to reduce the above-mentioned disadvantages.

The invention provides groove-cutting apparatus having a rotatable cutting drum comprising a plurality of spaced drum segments coaxially mounted on a central shaft, a plurality of secondary shafts spaced circumferentially around the central shaft and supported by the drum segments, and apertured cutting members mounted on the secondary shafts and spaced by the drum segments.

Preferably, each drum segment has a hub portion with a plurality of arms extending radially therefrom, each arm having an aperture accommodating one of the secondary shafts. Thus segments having hubs of different thicknesses may be used so as to provide any desired groove spacing.

Preferably, the hub portion of each drum segment is axially wider than the arms thereof and spacing means are provided on the secondary shafts between adjacent drum segments to hold the cutting members in substantial radial planes of the drum.

Preferably, the spacing means comprise disc-shaped spacers and collars, each collar having a cylindrical portion accommodated within the aperture of the respective arm.

Preferably, the apparatus has ground wheels coaxially-mounted with respect to the central shaft, thereby ensuring that the cutting drum follows the contours of a surface being cut.

Preferably, the apparatus comprises a suction fan connected to a dust collector.

Preferably, the dust collector comprises a filter, and the suction fan is arranged downstream of the filter.

The invention further provides a cutting member for use in the above-described apparatus and comprising an elongated plate having a cutting-tip insert mounted in a recess at one end of the plate, and an elongated aperture axially aligned with the cutting tip and arranged so that the centre of gravity of the plate is between the aperture and the tip, wherein the plate has a leading and a trailing edge having end portions tapering inwardly and downwardly to the cutting tip, the taper of the leading edge end portion being steeper than the taper of the trailing edge end portion.

Figure 2:
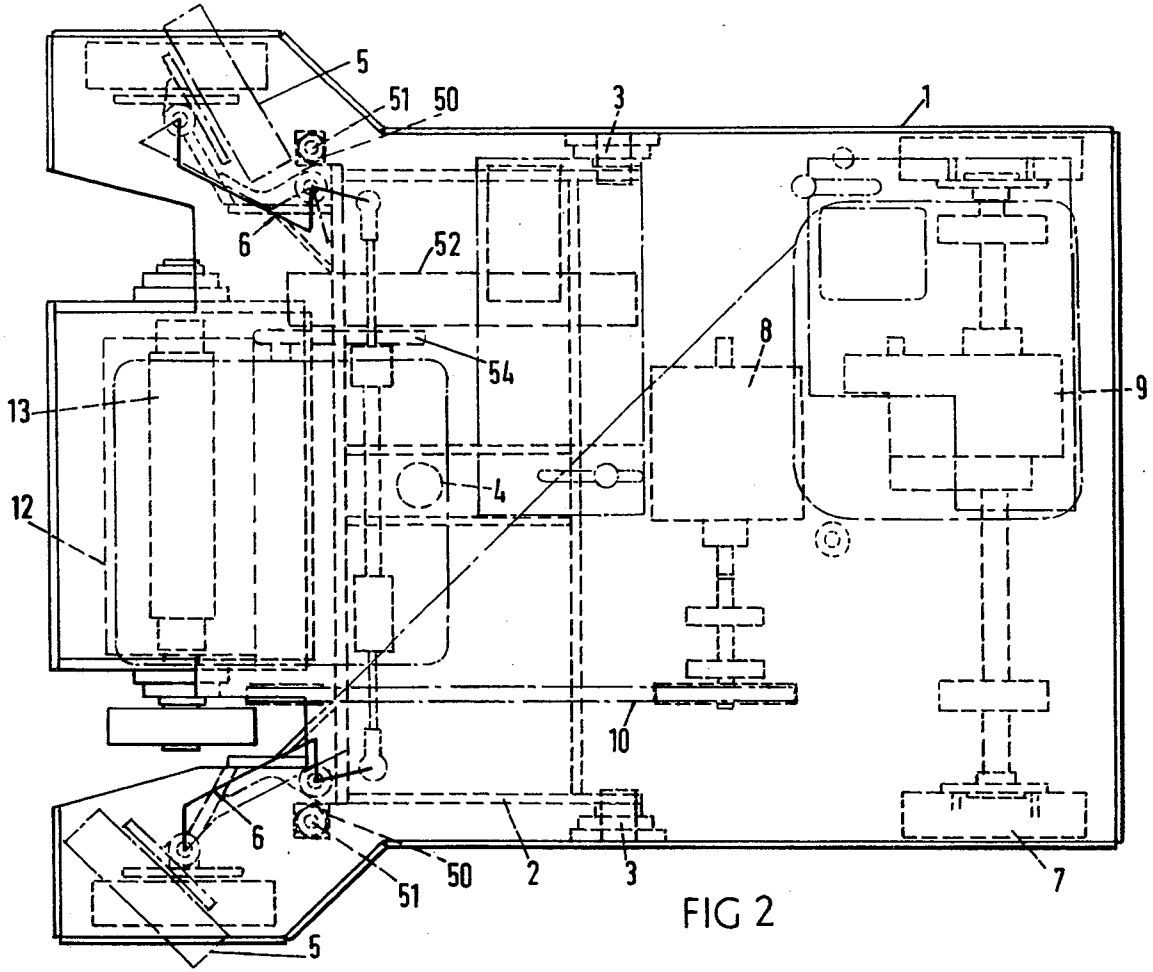
Figure 3:
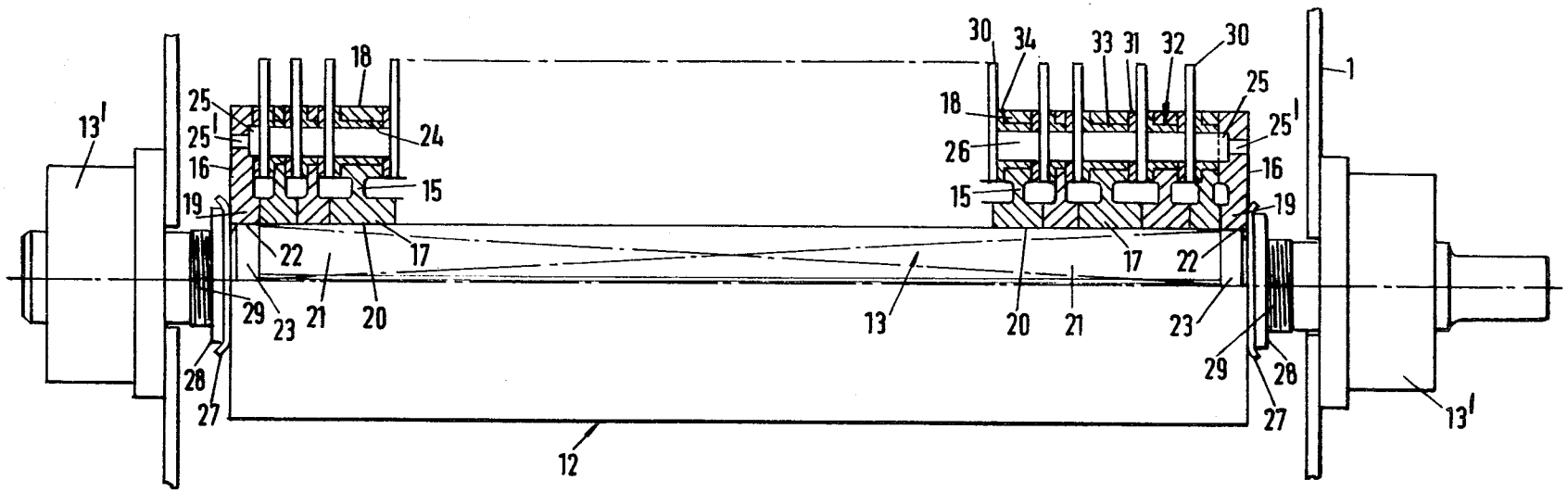
Figure 4:
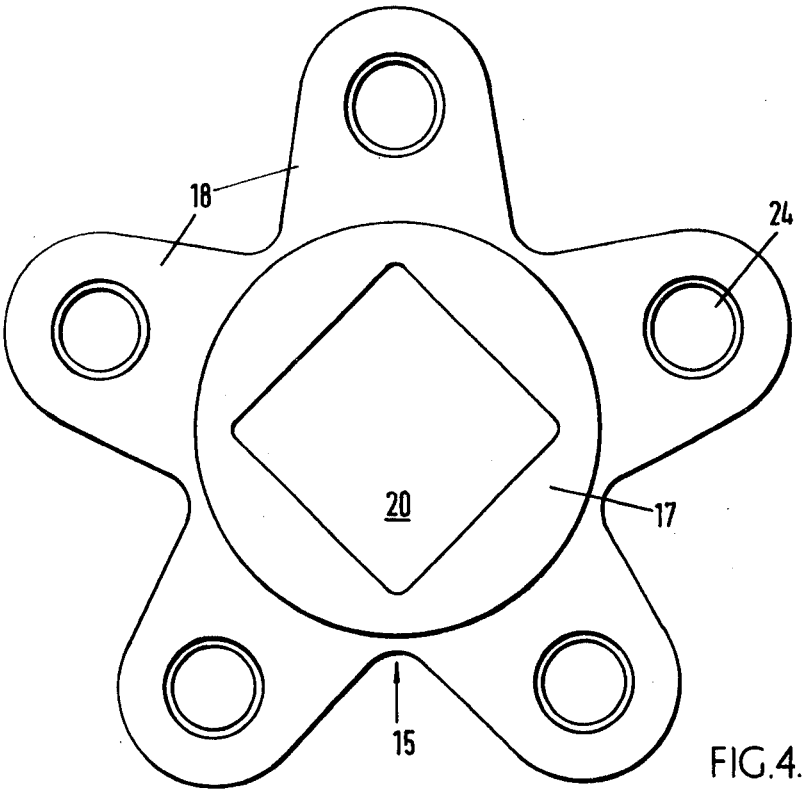
Figure 5:
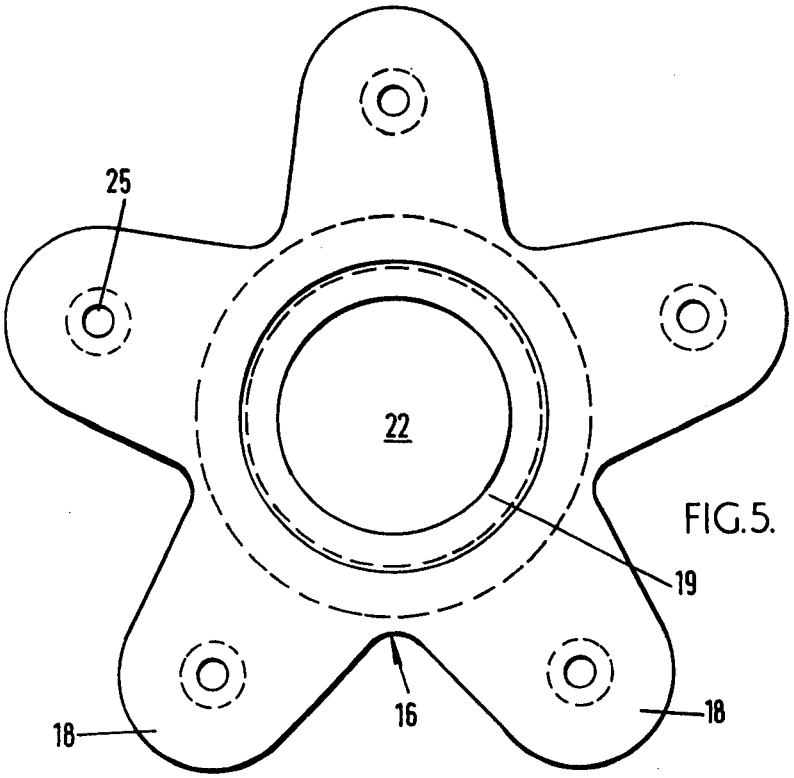
Figure 6:
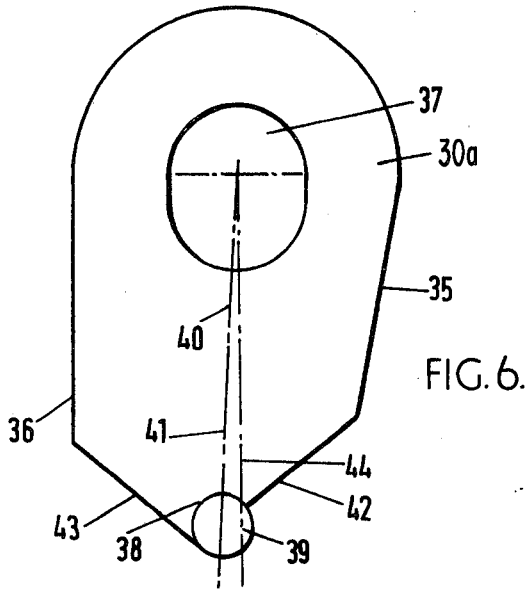
Figure 7:
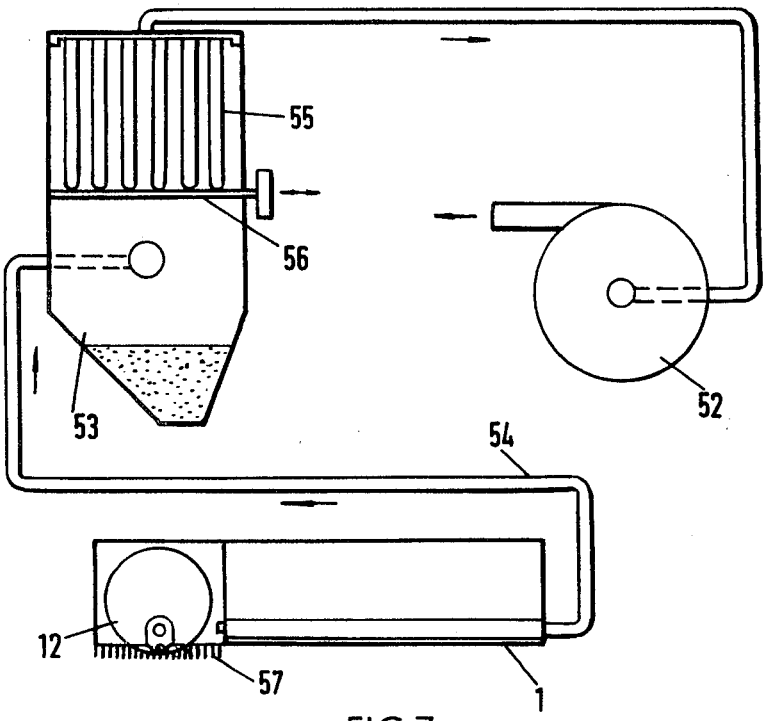

The invention will now be described with reference to an embodiment shown by way of example only in the accompanying drawings, wherein, FIG. 1 is a schematic side view of a groove-cutting apparatus, FIG. 2 is a schematic plan view of the apparatus of FIG. 1, FIG. 3 is the cutting drum of the apparatus of FIG. 1, FIG. 4 is a side view of a drum segment of FIG. 3, FIG. 5 is a side view of an end segment of FIG. 4, FIG. 6 is a side view of a preferred cutting member, and FIG. 7 shows diagrammatically the arrangement of dust collector and fan.

In FIGS. 1 and 2 the groove-cutting apparatus comprises a main frame 1, and a sub-frame 2 mounted within the main frame 1 on pivots 3. The sub-frame 2 is pivotable relative to the main frame 1 about the pivots 3 by means of an hydraulic or pneumatic ram 4, and carries front wheels 5 which are connected by an Ackerman linkage 6, although this may be dispensed with for small machines.

The main frame 1 carries rear wheels 7 driven by an infinitely-variable hydraulic transmission unit 8 via a differential gearbox 9. Infinitely-variable forward and reverse speeds of the machine are available on movement of a lever 8'. The transmission unit 8 is driven via a belt 10 by a motor 11 fixed to the main frame 1. The motor 11 may, for example, be petrol, diesel or electric powered.

A cutter drum 12 is rotatably mounted at the front of the machine and comprises a central shaft 13 rotatably mounted in the main frame 1 by means of bearings 13'. The shaft 13 is driven by the motor 11 via a belt 14. The motor 11 also powers a hydraulic pump (not shown) which operates the ram 4 for raising or lowering the drum 12. The pump is controlled by means of a lever 4'.

The construction of the cutter drum 12 is shown in detail in FIGS. 3 to 5. The cutter drum 12 comprises a plurality of intermediate drum segments 15 and two end segments 16 detachably mounted on the shaft 13. Each segment 15 has a hub portion 17 and radially-extending arms 18. As can be seen in FIG. 3, the hub portion 17 extends axially on either side of the arms 18. The end segments 16 also have hub portions 19 but these extend axially on one side only of the arms 18. Each intermediate segment 15 has a central square-shaped aperture 20 engaging a corresponding square-section portion 21 of the central shaft 13. Each end segment 16 has a central circular aperture 22 mounted on a cylindrical section 23 of the central shaft 13.

The arms 18 of the intermediate segments 15 are provided with apertures 24, and the arms 18 of the end segments 16 are provided with counterbored apertures 25 leading into smaller-diameter through-apertures 24'. Five secondary shafts 26 are mounted in the apertures 24 of the intermediate segments 15, and are held axially, with slight axial play, by the apertures 25 of the end segments 16. The end segments 16 are held on the central shaft 13 by lock washers 27 and lock nuts 28 engaging screw-threads 29 on the cylindrical portion 23 of the central shaft 13.

Between the segments 15, 16 the secondary shafts 26 carry tine-shaped cutting members 30 prevented from axial movement, apart from a slight play, by means of disc-shaped spacers 31 and collars 32. Each collar 32 has a cylindrical portion 33, passing through the aperture 24 of the adjacent arm 18, and a disc-shaped portion 34 having the same diameter as the spacer 31.

All the hub portions 17 of the intermediate segments 15 may be of equal thickness, and the cylindrical portions 33 of the collars 32 may be of equal length, so that the cutting members 30 cut equally-spaced grooves in the surface being cut. However, if different thickness segments 15 and corresponding different length collars 32 are used, different groove-spacings may be achieved. If the thickness of the spacers 31, of the portions 34 and of the cutting members 30 is the same and equal to *a*, then the thickness of the hub portion 17 of each intermediate segment 15 is greater than the thickness of the arms 18 by 3*a*. Furthermore, the length of the cylindrical portion 33 of each collar 32 should not be greater than, and should preferably be equal to, the thickness of the corresponding arms 18 through which they pass.

The drum may be assembled very quickly and easily. One end segment 16 is fixed on the central shaft 13 by means of the lock washer 27 and nut 28. For ease of assembly the shaft 13 may be held upright. The secondary shafts 26 are then inserted in the counterbored apertures 25. A washer 31 and cutting member 30 are slid along each secondary shaft followed by one collar 32 and one intermediate segment 15. As explained above, the length of the cylindrical portion 33 of the collar 32 should be the same as the thickness of the arms 18 of that collar, so that it is merely a question of selecting the correct size of collar 32 to go with the adjacent intermediate segments. The process is repeated until the cutting members 30 are spaced as required along all the secondary shafts 26.

Since the cutting members 30 are held between adjacent segments, they will be held in clearly-defined spaced transverse planes along the drum.

When all the cutting members 30 have been mounted, the other end segment 16 is adjusted until its counterbored apertures fit over the ends of the secondary shafts 26, and is held in place by means of the locknut 28 and the locking washer 27. Should one cutting member break then the remaining cutting members are unaffected and are still held axially in place on the secondary shaft 26 by means of the respective segments, collars and spacers.

When it is necessary to replace the cutting members, one of the locking washers 27 and locknuts 28 are unfastened, the respective end segment 16 is lifted until the counterbores 25 are free of the ends of the secondary shafts 26, and the end segment is rotated so that the ends of the secondary shafts now lie between the arms 18 of the end segment 16. The secondary shafts 26 need only be slid axially through the intermediate segments 15 and the cutting members 30 drop out. To facilitate freeing of each secondary shaft 26, a rod (not shown) may be inserted in the aperture 25' of the other end segment 16 and given a hard tap.

In order to alter the spacing of the cutting members, the intermediate segments 15 must also be rearranged.

A particularly advantageous shape of cutting member is shown in FIG. 6. The cutting member 30*a* is plate shaped and has a leading edge 35 and a trailing edge 36 and a longitudinal slot 37, the width of which is slightly greater than the diameter of the secondary shafts 26. However, the length of the slot 37 is considerably greater than the diameter of the secondary shafts 26 so as to provide for a prolonged impact of the cutting member on the surface being cut. The lower end of the cutting member 30*a* has a recess 38 into which a cutting tip 39 is inserted, which may, for example, be of tungsten carbide. The centre of gravity 40 of the cutting member lies below the slot 37 on the longitudinal axis 41 of the cutting member. The lower end of the cutting member 30*a* is tapered, the angle of the leading edge taper 42 being steeper than the angle of the trailing edge taper 43. As a result the axis of impact 44 of the cutting member 30*a* is slightly fowards of the longtiudinal axis 41.

Returning again to FIGS. 1 and 2, operation of the ram 4 allows the main frame 1 to pivot upwardly or downwardly about the rear wheels 7 thereby raising or lowering the cutter drum 12 relative to the front wheels 5. The downward movement of the main frame 1, and also of the cutter drum 12, is limited by means of a stop comprising a pair of brackets 50 mounted on the subframe 2 and a pair of screw-threaded rods 51 mounted in corresponding threaded apertures in the main frame 1.

The main frame 1 also carries a fan 52 driven by the hydraulic unit 8 and a dust collector. However, for the sake of clarity, only the fan 52 has been shown diagrammtically in FIG. 2. As can be seen from the arrangement shown diagrammatically in FIG. 7, the dust collector comprises a hopper 53, which is mounted on the main frame 1 and is connected downstream to the fan 52 and upstream to a conduit 54 which leads to a space just rearwardly of the cutter drum 12. Dust thrown up by the rotating cutter drum 12 as the cutting members strike the surface is sucked up by the fan 52 into the hopper 53. The dust is caught by a multi-fold felt filter 55 inside the hopper 53 and collects at the base of the hopper and may be removed periodically. A shaker 56 is provided so that the dust may be shaken periodically off the filter 55. The main frame 1 is provided with bristles 57 (see also FIG. 1) around the cutter drum 12 to hinder the escape of dust and particles.

Depending on the size of machine, the hopper 53 may be mounted at the side or rear of the main frame 1.

Various modifications may be made to the above-described embodiment without departing from the scope of the invention.

We claim:

1. Groove-cutting apparatus comprising a carriage carrying a rotatable cutting drum, and drive means for rotating the cutting drum, the cutting drum comprising a central shaft, a plurality of spaced drum segments coaxially mounted on the central shaft, a plurality of second shafts spaced circumferentially around the central shaft and supported by the drum segments, and apertured cutting members mounted on the secondary shafts and spaced by the drum segments, each of the cutting members including an elongated plate, and a cutting tip insert mounted in a recess at one end of the plate, each of the plates having an elongated aperture axially aligned with the respective cutting tip and arranged so that the center of gravity of the cutting member is between the respective aperture and cutting tip, and each of the plates having a leading edge and a trailing edge which tapers towards the respective cutting tip, the taper of the leading edge being steeper than the taper of the respective trailing edge.

2. Groove-cutting apparatus according to claim 1, wherein each drum segment comprises a hub portion and a plurality of arms extending radially therefrom, each arm having an aperture accommodating one of the secondary shafts.

3. Groove-cutting apparatus according to claim 2, wherein the hub portion of each drum segment is axially wider than the arms thereof, and spacing means are provided on the secondary shafts between adjacent drum segments to hold the cutting members in substantially radial planes of the drum.

4. Groove-cutting apparatus according to claim 3, wherein the spacing means comprise disc-shaped spacers and collars, each collar having a cylindrical portion accommodated within the aperture of the respective arm.

5. Groove-cutting apparatus according to claim 1, further comprising ground wheels coaxially mounted with respect to the central shaft, thereby ensuring that the cutting drum follows the contours of a surface being cut.

6. Groove-cutting apparatus according to claim 1, further comprising a suction fan, and a dust collector connected to the suction fan for sucking up dust formed during cutting of a surface.

7. Groove-cutting apparatus according to claim 6, wherein the dust collector comprises a filter, and the suction fan is arranged downstream of the filter.

8. A cutting member comprising an elongated plate, a cutting tip insert mounted in a recess at one end of said plate, an elongated aperture axially aligned with said cutting tip and arranged so that the centre of gravity of said plate is between said aperture and said tip, a leading and trailing edge each having an end portion tapering inwardly and downwardly to said cutting tip, the taper of said leading edge end portion being steeper than the taper of said trailing edge end portion.

* * * * *